United States Patent [19]

Benedyk et al.

[11] 4,449,712

[45] May 22, 1984

[54] METHOD OF PLAYING A CESTABALL GAME WITH A SCOOP DEVICE

[75] Inventors: Joseph C. Benedyk, Highland Park, Ill.; Homer C. Amos, Palm Springs, Calif.; Carl E. Scheie, Libertyville; William R. McGlone, Northfield, both of Ill.

[73] Assignee: Brunswick Corporation, Skokie, Ill.

[21] Appl. No.: 377,806

[22] Filed: May 13, 1982

Related U.S. Application Data

[63] Continuation of Ser. No. 158,267, Jun. 10, 1980, abandoned.

[51] Int. Cl.[3] ..... A63B 59/02

[52] U.S. Cl. ..... 273/326; 273/411

[58] Field of Search ..... 273/318, 322, 323, 326, 273/327, 411, 73 F, DIG. 8; 272/3

[56] References Cited

U.S. PATENT DOCUMENTS

| | | | |
|---|---|---|---|
| 642,638 | 2/1900 | Smith | 273/326 |
| 1,022,186 | 4/1912 | Engler | 273/322 |
| 2,029,790 | 2/1936 | Philipp | 273/326 |
| 2,930,618 | 3/1960 | Glintz | 273/323 |
| 3,635,482 | 1/1972 | Holman | 273/DIG. 8 X |
| 3,644,168 | 2/1972 | Bonk et al. | 273/DIG. 8 X |
| 3,671,040 | 6/1972 | Meyer et al. | 273/326 |
| 3,690,658 | 9/1972 | Howe | 273/73 F X |
| 3,697,074 | 10/1972 | Duncan | 273/326 |
| 4,045,026 | 8/1977 | Gillespie et al. | 273/326 |
| 4,068,840 | 1/1978 | Spaulding, Jr. | 273/411 X |
| 4,098,508 | 7/1978 | Gandy | 273/326 |
| 4,157,828 | 6/1979 | Cosmopulos | 273/323 X |

FOREIGN PATENT DOCUMENTS

| | | | |
|---|---|---|---|
| 140771 | 2/1935 | Austria | 273/322 |
| 64794 | 6/1955 | France | 273/323 |

OTHER PUBLICATIONS

*Sports Illustrated*, vol. 18, #1, p. 41, Jan. 1963.
*Sporting Goods Dealer*, Jun. 1971, p. 140.

*Primary Examiner*—William H. Grieb
*Attorney, Agent, or Firm*—John G. Heimovics

[57] ABSTRACT

This invention comprehends a new and unique method of playing a game and the rules of the game. The method provides for use of a scoop-cup means that has been impedance matched to a series of balls. Both the scoop-cup means and the balls have further been impedance matched to a person and thus to a court of play. In order to play the game, an inventive method has been provided that includes the rules and regulations of play.

45 Claims, 19 Drawing Figures

METHOD OF PLAYING A CESTABALL GAME WITH A SCOOP DEVICE

This is a continuation, of application Ser. No. 158,267, filed on June 10, 1980, now abandoned.

BACKGROUND OF THE INVENTION

1. Field of the Invention

This invention is in the field of games, and more particularly, a method of playing a game using a ball catching and throwing device, a ball and a court.

2. Description of the Prior Art

Pelota is the generic name for a group of ball games originally developed by the Basques. Some of these games exploit the mechanical advantage gained by throwing a ball from a basket. The game in which this mechanical advantage has been carried to an extreme is known, in this country, as "jai alai". The jai alai game is played by using a "chistera". This chistera is a heavy elongated wicker basket with a curved drooping belly. The basket is usually strapped to the hand and wrist of a player. The jai alai court is normally 90 yards long having a front wall, back wall and one side wall. A small, hard and rather heavy ball is used. The drooping belly portion of the basket is used to catch a ball rebounding from either the front wall or side wall. Once the ball is caught in the drooping belly and positioned, the basket is used to hurl the ball from that position toward the front wall. It requires years of training to develop the skill necessary to play jai alai because it is extremely difficult to catch a ball in the belly of a basket. It is reported that the ball achieves speeds of approximately 140 miles per hour during play of the game. It is equally difficult to learn how to hurl the ball from the basket and especially to hurl the ball where it can achieve speeds of about 140 miles an hour.

Because the game of jai alai is played in only about four states in the United States, because the game is so difficult to learn to play, and because the courts are so large and expensive to build, jai alai has not become a major or, as a matter of fact, a minor participant sport in the United States. However, there have been attempts to replicate or simulate some of the aspects of a modified jai alai game for the general public. One of these attempts was to make a smaller size and lighter weight chistera from plastic. The belly portion was provided with a resilient layer of padding to assist in catching the ball. This device is the subject of U.S. Pat. No. 4,098,508 and suggests that it is to be used to play "jai alai" on a conventional handball or racquetball court. However, the patent appears to be silent as to the type of ball to be used. Therefore, the device obviously was not tuned to a player, a court or a ball. This prior art also obviously does not teach a game.

In an old U.S. Pat. No. 1,022,186 a plurality of throwing devices are shown that are adapted to throw balls such as baseballs, tennis balls, badminton balls or birdies (maybe badminton was played with a ball in 1912) cricket balls and the like. In this device a pair of curved edges are provided to throw the projectiles mentioned. We have not been able to find either of these devices in the marketplace or in old catalogs and, therefore, must assume that they did not enjoy any commercial success.

In our search for prior art devices, we did find one toy, that was supposed to catch balls, manufactured by Cosom Division of Schaper Manufacturing Company and was possibly sold under the trademark name of Safe-T-Play. This device comprised a circular shape with a hollow handle made from a soft resilient plastic material. A side elevation view of this device with the ball shown in phantom is depicted in the drawings and labeled as "PRIOR ART". This device was found very awkward and clumsy to use and did not catch balls well. It also did not throw the balls well because its curvature was almost that of a circle.

Several years ago, a child's toy called "Trac Ball" was introduced into the marketplace. This Trac Ball toy seems to be similar to a toy described in U.S. Pat. No. 4,045,026. The toy utilizes a plastic basket with a handle for throwing and catching a light weight blow molded hollow sphere having a plurality of external ridges. The sphere or ball being made from such light weight material as expanded polystyrene. This patent teaches that serrated tracks in the basket impart spin to the ridged ball but if a smooth ball is used no spin can be imparted by the serrated tracks when the ball is thrown. From the commercially available toy described by this U.S. patent, it was determined that a pleasurable or challenging court-type ball game could not be played. In fact with the toy basket and ball provided, no court game could be played. Further, the patent covering this toy does not suggest that a court game could be played.

As any good golfer knows, as any good tennis player knows, as any good baseball player knows, there must be a good impedance match (as will be explained more fully hereinafter) between a golf club and a golf ball, a tennis racquet and a tennis ball, or a baseball and a baseball bat so that when hitting the ball properly a feeling of pleasure exists. In fact, this feeling is best described as kinesthetic pleasure. Concomitantly, it is a thrilling sensation to hit a ball in the "sweet spot" with a golf club, tennis racquet, baseball bat and the like; somehow this makes humans happy. Conversely, when trying to hit a baseball with a tennis racquet or a tennis ball with a badminton racquet there is no pleasure imparted to the player since the feeling is all wrong. Certainly, there is no kinesthetic pleasure experienced by the player.

It has been ascertained that in this vast area of prior art games, and in particular court-type games, i.e., tennis, racquetball, squash and the like that the racquet, the ball and the court are all tuned or impedance matched to the player so that a pleasurable game is experienced. These games were not scientifically designed but evolved over many, many years. In fact, there is a large body of prior art in the U.S. Patent Office regarding just the evolutionary development of tennis racquets and tennis balls.

Several "Trac Ball" baskets were modified to make them stronger and tried using them with a tennis ball to play a game in a racquetball court. Almost no pleasure was derived from this attempted game because the player, the basket, the ball and the court were not tuned; there were simply impedance mismatches. Up until now, none of the attempts to simulate, duplicate, replicate or approximate a court style jai alai game have been well thought out wherein the relationship between the ball catching and throwing device and the ball were scientifically designed. In fact, the basket whose shape and function are so critical, has apparently received little or no attention.

Based upon the attempt to use the "Trac Ball" baskets in a racquetball court, it was recognized that to provide a playable game it would be necessary to tune or impedance match the various components of the game and provide a method of playing a game.

In all the prior art, the devices were simply devices and did not comprise a game or a method of playing a game. When one wants to play tennis, baseball, golf, etc., the acquisition of a tennis racquet and tennis ball, a baseball glove, a baseball and a baseball bat or a set of golf clubs and a few golf balls does not constitute a game or a method of playing a game. Rules and regulations dictating the parameters and boundaries of the method of play are a necessity in order to define the game. The rules and regulations convert tennis equipment into a method of playing a pleasurable and enjoyable game.

SUMMARY OF THE INVENTION

In order to overcome the disadvantages and problems of the prior art devices and the lack of providing a game, we have invented a new and unique game and method of playing the game involving throwing and catching balls. The game and the method of play comprehend the use of a scoop and cup means that has been tuned or impedance matched to a ball. The ball and the scoop-cup means have further been impedance matched to a player for use in a court of play.

A player using the scoop-cup device with a properly matched ball experiences kinesthetic pleasure when throwing and catching the ball against a wall of the court. Our game and method of play have been taylored to include a scoop-cup device that has been named a chelesta. There are, specific configurations of the chelesta with very special types of balls having critical weight, size and bounce limitations for use in the method of playing our game.

It is therefore an object of this invention to provide a new and unique game and method of playing the game utilizing a device comprising a scoop and a cup portion for catching and throwing.

Another object of the invention is to provide a method of playing a game requiring a court approximately the size of the racquetball court.

Yet another object of the invention is to provide for a serving box in the court of play.

Still another object of the invention is to provide a set of rules adapted to provide a method of playing the game.

And yet another object of the invention is to provide a method of playing a game that will be easy for the beginning player and yet challenging for the player who has developed a high degree of skill.

Still another object of this invention is to provide a method of playing a game with new and unique equipment that has been impedance matched to the players and the court.

Still another object of this invention is to provide a method of play where the rules are determinative of the method of play.

The above and other and further objects, features and advantages will be more readily understood by reference to the following detailed description, the accompanying drawings and the appended claims.

DESCRIPTION OF THE PREFERRED EMBODIMENTS

Figure 1:
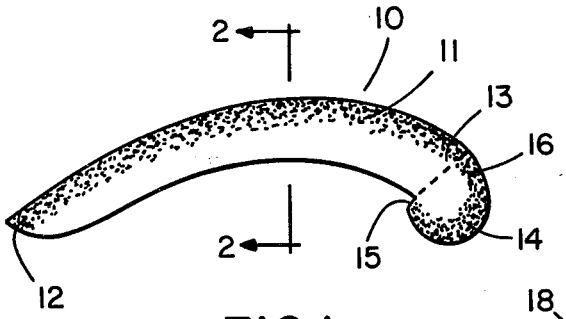
FIG. 1 is a side elevation view of one embodiment of the device used for the inventive method.
Figure 2:
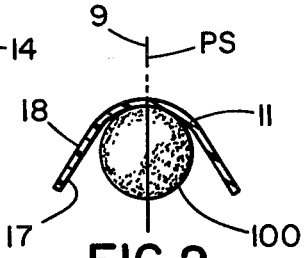
FIG. 2 is a cross-sectional view of the scoop means portion of the device taken along a line 2—2 of FIG. 1 and also depicting a ball in the scoop means.

This invention comprehends a method of playing a game utilizing a ball catching and throwing device (hereinafter referred to as a scoop device) that has been tuned, or more precisely, impedance matched to a series of balls for play in a court. The invention comprehends the use of a court having one or more relatively smooth walls. The invention also comprehends a game with a series of balls tuned to the scoop device such that when a player, using the scoop device, throws a ball or catches a ball rebounding from a wall a pleasure feeling is experienced. In a preferred embodiment of the one device as depicted in FIG. 1, the chelesta 10 comprises a scoop portion 11 having a distal end 12 and a proximal end 13 and a cup portion 14 having an open edge 15 and a closed edge 16. The chelesta 10 can be made in two parts such that the proximal end 13 of the scoop means 11 is secured to the closed edge 16 of the cup means 14. Alternatively, the scoop device 10 can be made such that scoop means 11 and the cup means 14 are integral. The scoop means 11 has an inner surface 17 and an outer surface 18 as shown in FIGS. 2 and 4. The scoop device 10 (scoop-cup means) depicted in FIG. 3 has a plane of symmetry dividing the chelesta into right hand and left hand sections which are equal but opposite with axis 9 representing the plane. The scoop device can be made on a mold with one right-hand section and one left-hand section and then joined at the plane of symmetry to make a completed scoop device.

It has been found that at least a portion of the scoop means 11 at the axis and plane 9 has the configuration of a hyperbolic spiral thereby permitting a player using the scoop device to catch a ball in a comfortable manner. In certain types of catches, the hyperbolic spiral permits a ball striking the scoop device to roll up into the cup means 14. Conversely, when throwing the ball from the cup means 14 the ball rolls out along the scoop means 11.

Figure 5:
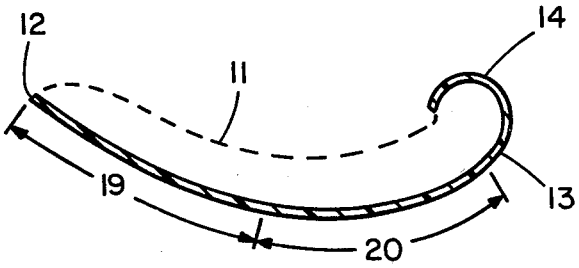
FIG. 5 is a cross-sectional side view of one embodiment of the device taken along the plane of symmetry PS—PS of FIG. 3.
Figure 6:
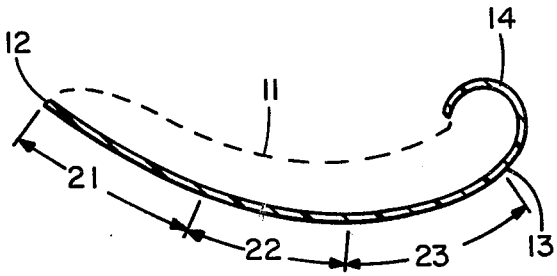
FIG. 6 is a cross-sectional side view of another embodiment of the device taken along the plane of symmetry PS—PS of FIG. 3.

In the embodiment of the chelesta shown in cross-sectional view in FIG. 5, either portion 19 or portion 20 of the curve can have the shape of a hyperbolic spiral. In an alternative embodiment of the invention shown in FIG. 6 at least one of the portions 21, 22, or 23 along the curve of the scoop means 11 has the configuration of a hyperbolic spiral. Several of the alternative embodiments included within the scope of the invention and depicted in FIG. 6 provide that two of the three portions of the curve have the shape of a hyperbolic spiral.

Figure 7:
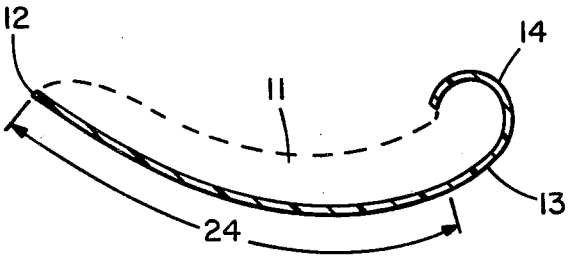
FIG. 7 is a cross-sectional side view of another embodiment of the device taken along the plane of symmetry PS—PS of FIG. 3.

In one preferred embodiment of the device, a majority of the scoop means 11 has a hyperbolic spiral curve configuration portion 24 as shown in FIG. 7. And, preferrably, the total scoop device has a curve that is substantially totally a hyperbolic spiral curve similar to that depicted in FIG. 8. In all the embodiments of the device discussed hereinabove, the distance between the open edge 15 and the closed edge 16, represented by the dimension "A", is at least 5 percent greater than the diameter of the ball in order for the ball to be able to roll into or be caught by the cup means 15. Preferrably, the dimension "A" ranges from 5 to 80 percent greater than the diameter of the ball; but, a larger dimension than 80 percent is fully contemplated.

Figure 8:
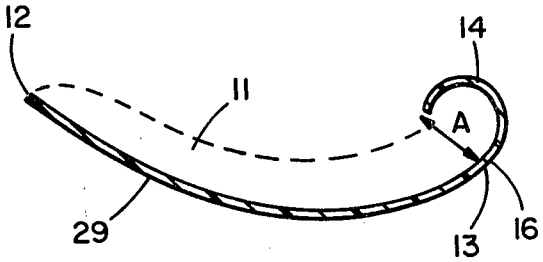
FIG. 8 is a cross-sectional side view of another embodiment of the device taken along the plane of symmetry PS—PS of FIG. 3.

In the preferred embodiment of the device as shown in FIG. 8, the hyperbolic spiral curve has a formula in polar coordinates of $$R\theta = C$$

where:

R is the radius measured in centimeters;

$\theta$ is the angle measured in radians; and

C is a constant measured in centimeter-radians.

Figure 9:
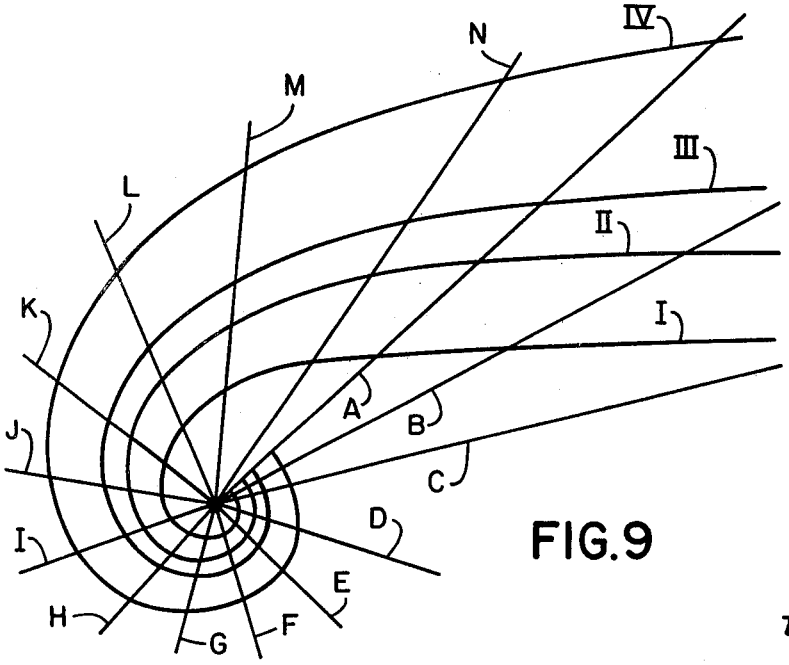
FIG. 9 is a schematic view of a series of hyperbolic spiral curves I, II, III and IV formed about a center axis along radial lines A–N and where a segment is that portion of a curve located between two adjacent radial lines, i.e., L to M on curve IV defines a segment.

In constructing the hyperbolic spiral curve that is represented by the numeral 29 of the embodiment shown in FIG. 8, the values of R range from 1.5 to 60 centimeters; the values of C range from 10 to 30 centimeter-radians and $\theta$ for hyperbolic curve should comprise at least 2 radians. FIG. 9 is a schematic representation of the minimum and maximum hyperbolic spiral curves contemplated therein with several intermediate curves shown therewith. In FIG. 9 the C values of the four curves are as follows:

| Curve | "C" |
|---|---|
| I | 10. |
| II | 16 |
| III | 20 |
| IV | 30 |

As used hereinafter, the term "hyperbolic segment" or "segment" refers to a portion of a radian spacing along one of the curves. in the preferred embodiments of the device, all of the curves shown in FIGS. 1 and 3–7 of the scoop means 11 comprise at least two of the segments as part of the scoop curve. The segments will be similar to those depicted between the lines C to B to A to N and to M or C to B to A (at the larger diameter). The segments need not be immediately adjacent to each other on the scoop-means curve but can be separated by a partial or full radian span that has another configuration such as a straight portion or a different type of curve such as a portion of a circle. These different types of curves comprise at least a portion of the hyperbolic spiral curve of the chelesta and are fully contemplated to be within the scope of this invention. In fact, the segments need not be immediately adjacent but can be spaced apart by a partial radian span, a whole radian span, or even as much as a two radian span that are not the hyperbolic curve as long as adjacent and/or intermediate portions are of the hyperbolic spiral curve configuration. A straight or curved portion can be inserted between the segments of the hyperbolic spiral curve and yet provide a chelesta having an adequate curve to catch and throw the ball.

Figure 10:
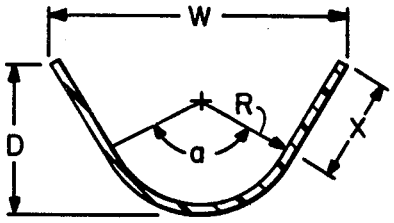
FIG. 10 is a modified V-shape cross-sectional view of the device such as taken along line 2—2 of FIG. 1 depicting the dimensional aspects of the cross-sectional configuration.

In a preferred embodiment of the device, a major part of the scoop portion curve of the chelesta is the hyperbolic spiral such as that portion from the radial line K and including segments through radial line A and even as far as radial line B for curve I. It has been found that the overall length of the chelesta should be between 30 centimeters and 60 centimeters and more preferrably the length of the chelesta ranges from 35 to 50 centimeters. It has been found that the cross-sectional shape of the scoop means, greatly contributes to the scoop device's ball catching and throwing ability. The chelesta can have a U-shaped or V-shaped cross-sectional configuration and preferrably has a modified U-shape or V-shape or a combination of a U-shape and a V-shape configurations that are blended together. Additionally, it is fully contemplated that the cross-sectional shapes can vary along the length of the scoop. FIG. 10 depicts the general V-shaped configuration with:

a being the included angle of the curve;

R being the radius;

D being the depth of the scoop means;

X being the length of the straight side of the modified V-shape; and

W being the width of the top portion of the cross-sectional configuration of the scoop means.

The cross-sectional shapes vary from the distal end 12 to the proximal end 13. In fact, it has been found desirable to flare the distal end in some instances. The radius R ranges from 3 centimeters to 5 centimeters; the angle a ranges from 80 degrees to 180 degrees; the depth D ranges from 2 centimeters to 6½ centimeters; the straight length of the side X varies from slightly more than zero to 6 centimeters and the width W ranges from 4 centimeters to 13 centimeters.

Figure 11:
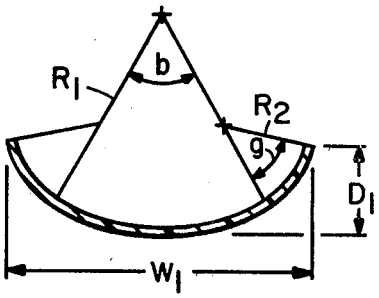
FIG. 11 is a modified U-shape cross-sectional view of another embodiment of the device which could have been taken along line 2—2 of FIG. 1 depicting the dimensional aspects with a cross-sectional configuration.

In the embodiment of the device when the cross-sectional configuration of the scoop device is a modified U-shape, as shown in FIG. 11 wherein:

$W_1$ is the overall width;

$D_1$ is the depth;

$R_1$ is the primary radius;

$R_2$ is the secondary radius;

b is the included angle for the curved portion at radius $R_1$; and g is the included angle for the secondary radius $R_2$.

Again, the cross-sectional shape varies from the distal end to the proximal with the width $W_1$ ranging from 6 to 11.5 centimeters; the depth $D_1$ ranging from 2.5 to 4.5 centimeters; the primary radius $R_1$ ranging from 3.5 to 11 centimeters; the secondary radius $R_2$ ranging from 2.7 to 4.3 centimeters; the included angle b ranging from 30 degrees to 180 degrees; and the included angle g ranging from 45 degrees to 75 degrees.

Figure 12:
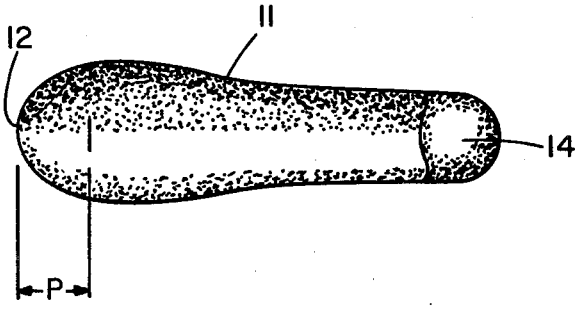
FIG. 12 is a top plan view of an embodiment of the device wherein the dimension P represents a distance from the distal end of the scoop means.

A schematic front view of the scoop device is depicted in FIG. 12 wherein the dimension P is measured in centimeters from the distal end 12 toward the cup 14. The following represent Examples of the chelestas that were made with different cross-sectional configurations and different dimensions for use in playing the inventive method.

EXAMPLE A

The cross-sectional configuration of this scoop device was made in accordance with the V-shape of FIG. 10. The different cross-sectional sections having the following dimensions.

| P | R | a | X | W | D |
|---|---|---|---|---|---|
| 5–10 | 3.65 | 90 | 4.0 | 10.8 | 3.5 |
| 10–15 | 3.65 | 100 | 4.0 | 10.6 | 4.0 |
| 15–20 | 3.65 | 110 | 3.3 | 9.6 | 4.0 |
| 20–25 | 3.65 | 120 | 2.0 | 8.2 | 3.60 |
| 25–30 | 3.65 | 175 | 0.0 | 7.2 | 3.50 |
| 30–35 | 3.45 | 175 | 0.0 | 6.8 | 3.40 |
| 35–40 | 3.45 | 180 | 0.0 | 6.8 | 3.45 |
| 40–45 | 3.45 | 180 | 0.5 | 6.8 | 3.60 |

EXAMPLE B

The cross-sectional configuration of this scoop device was made in accordance with the V-shape of FIG. 10. The different cross-sectional sections having the following dimensions:

| P | R | a | X | W | D |
|---|---|---|---|---|---|
| 5–10 | 3.65 | 90 | 4.0 | 10.8 | 3.5 |
| 10–15 | 3.65 | 100 | 4.0 | 10.6 | 4.0 |
| 15–20 | 3.65 | 110 | 3.3 | 9.6 | 4.0 |
| 20–25 | 3.65 | 120 | 2.0 | 8.2 | 3.60 |
| 25–30 | 3.65 | 180 | 0.0 | 7.2 | 3.65 |
| 30–35 | 3.45 | 180 | 0.5 | 6.8 | 3.70 |

EXAMPLE C

The cross-sectional configuration of this scoop device was made in accordance with the V-shape of FIG. 10. The different cross-sectional sections having the following dimensions:

| P | R | a | X | W | D |
|---|---|---|---|---|---|
| 5–10 | 3.5 | 90 | 5.0 | 11.6 | 4.6 |
| 10–15 | 3.5 | 90 | 4.0 | 11.5 | 5.0 |

-continued

| P | R | a | X | W | D |
|---|---|---|---|---|---|
| 15–20 | 4.0 | 105 | 3.0 | 10.1 | 4.6 |
| 20–25 | 4.2 | 180 | 0.0 | 8.9 | 4.2 |
| 25–30 | 3.9 | 180 | 0.8 | 7.9 | 4.7 |
| 30–35 | 3.6 | 180 | 1.2 | 7.4 | 4.8 |

EXAMPLE D

The cross-sectional configuration of this chelesta was made in accordance with the V-shape of FIG. 10. The different cross-sectional sections having the following dimensions:

| P | R | a | X | W | D |
|---|---|---|---|---|---|
| 5–10 | 3.4 | 90 | 5.0 | 12.0 | 4.5 |
| 10–15 | 3.2 | 95 | 5.0 | 11.3 | 4.8 |
| 15–20 | 3.2 | 98 | 4.6 | 10.2 | 4.8 |
| 20–25 | 3.2 | 103 | 4.0 | 9.3 | 4.8 |
| 25–30 | 3.4 | 130 | 3.2 | 8.2 | 4.9 |
| 30–35 | 3.3 | 140 | 3.2 | 7.9 | 5.4 |

EXAMPLE E

The cross-sectional configuration of this scoop device was made in accordance with the U-shape of FIG. 11. The different cross-sectional sections having the following dimensions:

| P | R | b | R | g | W | D |
|---|---|---|---|---|---|---|
| 5–10 | 10.0 | 34 | 4.0 | 50 | 10.5 | 2.7 |
| 10–15 | 9.0 | 38 | 3.5 | 55 | 10.0 | 2.8 |
| 15–20 | 8.0 | 40 | 3.5 | 60 | 9.2 | 2.9 |
| 20–25 | 7.0 | 42 | 3.0 | 66 | 8.6 | 3.0 |
| 25–30 | 5.0 | 74 | 3.0 | 52 | 8.2 | 3.4 |
| 30–35 | 4.3 | 170 | — | — | 8.2 | 3.8 |

EXAMPLE F

The cross-sectional configuration of this scoop device was made in accordance with the U-shape of FIG. 11. The different cross-sectional sections having the following dimensions:

| P | R | b | R | g | W | D |
|---|---|---|---|---|---|---|
| 5–10 | 9.0 | 38 | 3.5 | 55 | 10.0 | 2.8 |
| 10–15 | 8.0 | 40 | 3.5 | 60 | 9.2 | 2.9 |
| 15–20 | 7.0 | 42 | 3.0 | 66 | 8.6 | 3.0 |
| 20–25 | 5.0 | 74 | 3.0 | 62 | 8.2 | 3.4 |
| 25–30 | 4.3 | 170 | — | — | 8.2 | 3.8 |

It has been found that in the embodiments of the device that the combination of the hyperbolic spiral portion of the inner surface 17 combines in a synergistic and unexpected manner with the modified U-shape or V-shape cross-sectional configuration of the scoop means 11 to impart spin to the ball when it is thrown from the cup means 14. This is made possible since the ball can be made to initially roll out along the central axis 9 or plane of symmetry PS and then roll off the side portion along the flat or curved portion of the cross-sectional configuration. An example of the off center roll of the ball 100 is shown in FIG. 2. In a preferred embodiment of the invention, the ball should have a radius smaller than the radius of the cross-sectional configuration of the scoop means when the scoop means is a modified V-shape as shown in FIG. 10.

It is fully contemplated that the hyperbolic spiral can be deviated from such that the scoop means can have a curved configuration of a circular arc (such as can be observed in FIG. 14) provided that the scoop-cup combination has a length ranging from 30 centimeters to 60 centimeters, a weight of approximately 150 grams to 300 grams, a polar moment of inertia (as hereinafter explained) ranging from $6\times10^4$ to $12\times10^4$ grams-centimeters$^2$, a depth of the scoop means ranging from about 2 centimeters to 6 centimeters and has a value for $mL^2$ greater than 0.85. Obviously, the circular arc can also be deviated from and still bring the scoop configuration within the scope of our invention.

It is contemplated for the inventive method that the scoop device can be made from a fabric made from fibrous materials such as nylon, polyester, fiber glass, acrylic, wool, kevlar, mineral wool, cotton, rayon, silk, jute, and polypropylene impregnated with a plastic material such as ABS, epoxy, polypropylene, polyethylene, polycarbonate, polyester, polyimide, polyamide and phenolic to name only a few. One or more impregnated layers can be layed up on a mandrel having the desired scoop device configuration. If desired, layers of plastic material can be placed in between the impregnated layers of fabric. These laminates can be cured, if desired.

Figure 13:
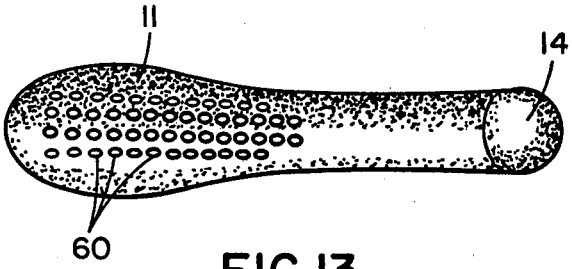
FIG. 13 is a top plan view of an elevation of the device where holes are depicted in the scoop means.

Alternatively, in another embodiment the scoop device can be made from a textile fabric impregnated by a foamed plastic material. In an alternate embodiment, the textile fabric, either plain or impregnated with a plastic material, can have a plastic foam sandwiched therebetween two fabric layers. In both types of embodiments, the plastic foam can be made from polyurethene, polyester, polyamide, blown cellular foam, such as styrofoam, and a plurality of syntatic foams, just to name a few. In another alternate embodiment, plastic material with or without filler and/or reinforcing materials such as textile-type fibers (made from the type of fibrous materials as listed hereinabove for fabric layers) can be injected into a mold to make the scoop means 11, the cup means 14 or both the scoop and cup means together in one integral piece. If a chillable injection mold is used, some foam plastic materials can be injected therein wherein hard outer skins are formed with a less dense core. It has been found necessary that the scoop device be sufficiently rigid to be useable as a ball catching and throwing device. Obviously when thin material is used, the scoop device structure can be reinforced on the outer surface 18 with ridges or longitudinal supports. Depending upon the method of manufacture and the weight of the material utilized, the scoop device should have a thickness ranging from about 0.125 centimeters to 1 centimeter. In order for an individual to play with the chelesta for any period of time, it has been found necessary that the scoop device (without considering the hand attaching means such as a glove) should have a weight from about 130 grams to about 300 grams. In order to lighten the weight of the scoop device when made from denser materials, holes 60 can be placed in the scoop means 11, as shown in FIG. 13, without affecting the rigidity or playability of the scoop device.

Figure 14:
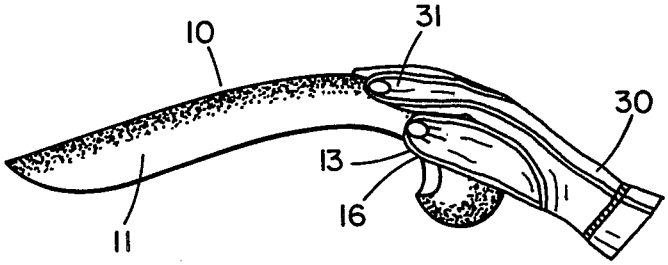
FIG. 14 is a side elevation view of an embodiment of the device for playing the inventive method.
Figure 15:
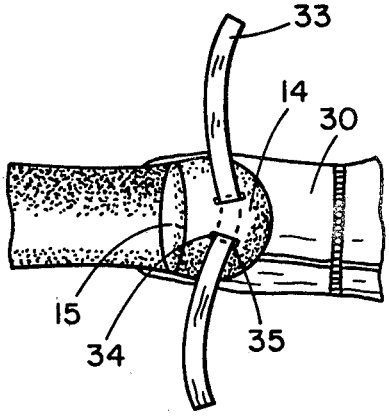
FIG. 15 is a partial top elevation view of part of the embodiment shown in FIG. 14.

Although the scoop device can be held by an individual's hand, it has been found desirable that a glove be secured to the scoop device making play much easier. As shown in FIG. 14, a glove 30 is secured to the scoop device near the proximal end 13 and the closed edge 16. Initially, the fingers 31 of the glove were sewn to the scoop means as the only means of attachment, but it was found that this permitted the hand and especially the palm to move too much relative to the scoop-cup means thereby causing a player's hand to tire rapidly. It was found necessary and as a preferred embodiment of the invention that the fingers 31 of the glove 30 are attached to the scoop means 11 by adhesive rivets, or the like. It is desirable that the palm 32 of the glove 30 is also secured fairly rigidly to the scoop and cup means such as by adhesive, a nylon hook and loop fastener (Velcro fastener), plastic or metal rivets or the like. As shown in FIG. 15, it has been found quite desirable to have an auxiliary strap 33 secured to the cup means 14 at about 34 such as by positioning the strap 33 in slots 35. The strap 33 is fastened around the player's hand in order to provide a more stable arrangement for the player's hand when using the scoop device. It has been found that the wrist strap 33 preferrably should be fastened around the individual player's hand on the hand side of the wrist joint in order to permit full movement of the hand during play so that the scoop device is an extension of the player's arm. The wrist strap 33 can be secured around the player's hand by tying the ends thereof together, by a hook and loop fastener or the like. Alternatively, the strap 33 can be secured to the cup means by means of snaps, adhesive or the like.

Figure 19:
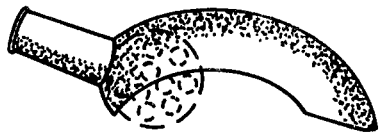
FIG.19 PRIOR ART
FIG. 19, labeled Prior Art is a side elevation view of one item of prior art.

An alternative embodiment of the device depicted in FIG. 19 is where a handle 62 is secured to the cup means 14. The handle 62 can be used in place of the glove and strap means but it has been found to make play more difficult.

During play with the scoop device, it has been noted by some players that they like the glove 33 positioned so that the thumb and little finger cannot grip the sides of the scoop-cup means in the area located relatively close to the proximal end 13 and the closed edge 16. Therefore, the tips of the thumb and little finger of the glove 30 are positioned close to the tips of the remaining fingers of the glove that are secured to the scoop device. However, it has been determined that a majority of players like to grip the sides of the scoop-cup means and therefore the tips of the thumb and little finger are spread apart from the tips of the other fingers a sufficient distance in order to permit the desired side gripping.

In order for the game to be enjoyably played with a scoop device, it was necessary to design a ball that provided a good impedance match therewith. The impedance match required that the ball have a certain size, special surface, specific weight range, dynamic coefficient of friction with respect to the scoop device inner surface 17 and a coefficient of restitution (the rebounding ability or liveliness of the ball). The impedance match is directly related to the energy transfer between the scoop device and the ball. Broadly, we determined that the ball should have a diameter range from about 5 centimeters to 7.6 centimeters and preferably from 5.7 to 6.5 centimeters. Most preferably, the ball as a diameter ranging from about 6.2 centimeters to 6.43 centimeters when the scoop device is within its most preferred dimensional ranges. It was found that the balls should have a textile-type surface covering in order to provide a dynamic coefficient of friction ranging from 0.1 to 0.4 as measured between the inner surface 17 and the surface of the ball. The dynamic coefficient of friction was ascertained by tests performed on the "Instron Coefficient of Friction Fixture", Manual number 10- 53-1, Catalog number 2810-005, published and copyrighted in 1973 by the Instron Corporation. In a preferred embodiment, the flocked balls have a weight ranging broadly from 60 grams to 90 grams and more preferably from 70 grams to 88 grams. The most preferred weight range of balls is from 72 grams to 86 grams.

The balls have a coefficient of restitution e which is calculated by the formula:

$$e = \sqrt{\frac{H_2}{H_1}}$$

wherein $H_1$ is the known distance that a ball is dropped from over a flat rigid surface and $H_2$ is the height to which the dropped ball rebounds. It has been determined that the best balls that are impedance matched to the scoop device have a coefficient of restitution ranging from 0.60 to 0.75 wherein $H_1$ is about 230 inches. Preferably, this range is about 0.65 to 0.73 and most preferably this range is about 0.67 to 0.70. It was determined that the textile-type outer surface could be a non-woven textile material and more preferably the outer surface of the ball was covered with a flocked material. The material covering the outer surface can be selected from textile fibers of fiber glass, nylon, polyester, acrylic, wool, cotton, rayon, silk, polypropylene and the like. It was found that the balls having a good impedance match with the scoop device are made of substantially solid foamed material that may have a thin outer surface film surrounding the ball underneath a flocked surface. However, non-foamed balls can also perform adequately.

The following Table III lists a group of balls determined to comprise a good impedance matched to the chelesta:

TABLE III

| Ball | Weight in Grams | e* |
|---|---|---|
| I | 84 | .69 |
| II | 80 | .68 |
| III | 74 | .68 |
| IV | 86 | .73 |
| V | 72 | .64 |
| VI | 72 | .64 |

*$H_1$ drop height approximately 230 inches

Other balls such as standard racquetballs, handballs, and squashballs were used with the chelesta but proved not to have a good impedance match and therefore when a game was played it was found to be not very enjoyable or pleasurable.

For average size individuals, the limits of the length of this scoop device are surprisingly narrow. Over the length range of about 45 to 60 centimeters, the scoop device becomes clumsy and unwieldly. Conversely, at about 30 centimeters or less, the power and the pleasure in throwing the ball are gone since so much snap is required as to be hard on a player's wrist. There is a good reason why these length limitations are so. The length and mass distribution combine to give a moment of inertia about the wrist joint. This moment is critical to giving a good impedance match between the human being and the ball. With a good impedance match you have a very enjoyable game—with poor impedance match you have no game at all.

Figure 16:
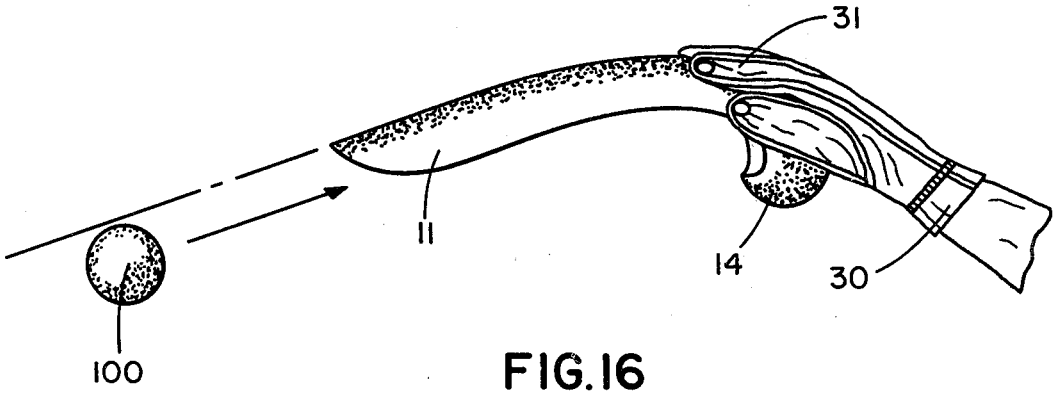
FIG. 16 is a side elevation view of one embodiment of the device wherein the ball is tangent to the curve of the scoop means.

The scoop device is designed to make a successful catch at any angle up to normal near the tip and anywhere in the scoop if the angle is substantially tangential, see FIG. 16.

The most difficult part of the design is to satisfy the condition when the ball hits approximately normal or perpendicular to the scoop curve. The mechanism of ball capture by the scoop device was analyzed both before and after impact of the ball to insure that the scoop device was impedance matched to the ball so that the ball will not rebound from the scoop device.

Figure 17:
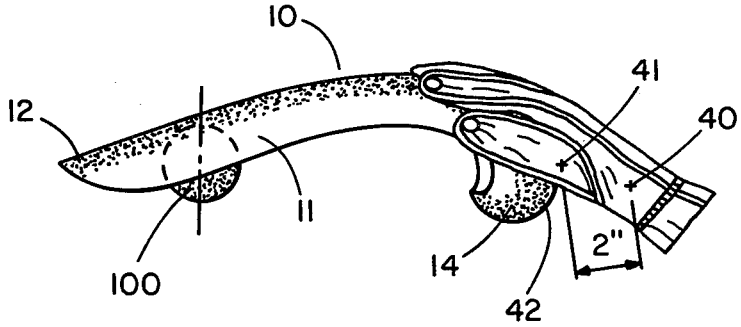
FIG. 17 is a side elevation view of one embodiment of the device depicting the ball striking the scoop means and the relative position between the axis 40 and other parts of the device.

By adapting standard mechanics principles for the conservation of angular momentum, a formula was obtained that predicted whether or not the scoop device will capture the ball when it strikes the scoop means approximately normal or at an angle directed toward the cup means. This formula is:

$$mL^2/I > e$$

wherein:

m = the mass of the ball in grams;

L = the distance from the point of impact of the ball 100 (see FIG. 17) about an axis* at 40 passing through the wrist of a player holding the scoop device wherein 40 is approximately 2 inches from the end 42 of the cup 14 or the axis at 41;

I = the polar moment of inertia about the axis at 40 including the weight of the hand and glove as shown in FIG. 17; and e = the coefficient of restitution of the ball.

Figure 3:
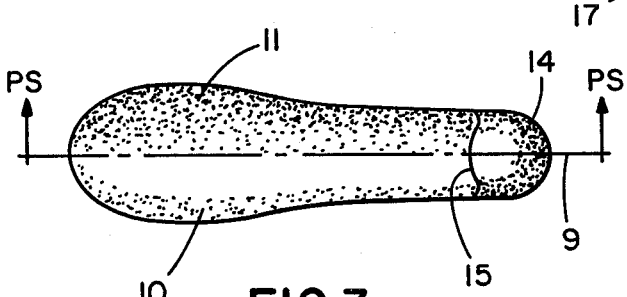
FIG. 3 is a top plan view of the embodiment of the device shown in FIG. 1.
Figure 4:
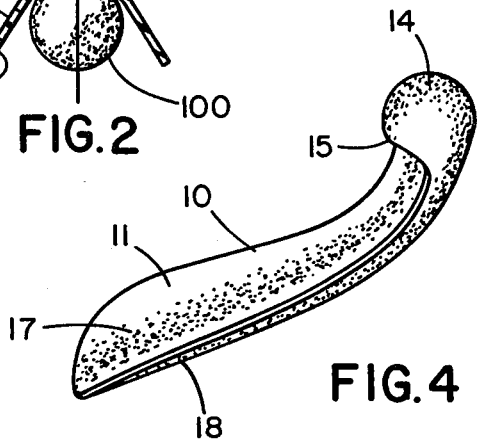
FIG. 4 is a perspective view of one embodiment of the device used in the method of play.

*The axis at 40 and 41 is perpendicular to the axis of symmetry PS of the scoop device as shown in FIG. 3.

It has been found that the scoop device alone has a polar moment of inertia about an axis 40 perpendicular to the plane of symmetry PS (see FIG. 3) ranging from $6\times10^4$ to $12\times10^4$ gm-cm$^2$. This particular characteristic is used in designing our scoop device so that the ball will not rebound from the scoop means.

The following examples of chelestas were made and used in the inventive method and should not be construed in any way to limit the scope contemplated by this invention.

EXAMPLE I

A scoop device, similar to the one shown in FIG. 1, had the following physical and structural characteristics:

(1) weight = 156 grams;

(2) length = 17 inches or about 43 centimeters;

(3) cross-sectional configuration is a modified U-shape similar to FIG. 11;

(4) thickness is approximately 2 millimeters;

(5) the distance from the distal end that the ball strikes the scoop means is about 3 inches or 8 centimeters; therefor $L=(48-8)=40\times$cm;

(6) the mass of the ball is 84 grams;

(7) the polar moment of inertia is $14.5\times10^4$ grams-centimeters$^2$;

(8) the coefficient of restitution for the 84 gram ball is 0.69; and (9) the center of gravity from the end of the cup is about 7 inches or 17¾ centimeters; Therefore, $$\frac{(84)\times(40)^2}{14.5\times10^4} = .91 > .69$$

EXAMPLE II

A scoop device, similar to the one shown in FIG. 1, had the following physical and structural characteristics:

(1) weight=158 grams;

(2) length=17 inches or approximately 43 centimeters;

(3) cross-sectional configuration of the scoop means is a modified V-shape similar to FIG. 10;

(4) thickness is approximately 2½ millimeters;

(5) the distance from the distal end that the ball strikes the scoop means is about 5 inches or 12 centimeters; therefore, L=(48−12)=38 centimeters;

(6) the mass of the ball is 74 grams;

(7) the polar moment of inertia is $12.4\times10^4$ gram-centimeters$^2$;

(8) coefficient of restitution for the 84 gram ball is 0.68;

(9) the center of gravity from the end of the cup is 6 inches or about 15.3 centimeters.

Therefore, $$\frac{(74)\times(36)^2}{12.4\times10^4}=.79>.68$$

EXAMPLE III

A scoop device, similar to the one shown in FIG. 1, had the following physical and structural characterists:

(1) weight=183.5

(2) length=17 inches or about 43 centimeters (3) the cross-sectional configuration of the scoop means, modified U-shape similar to FIG. 11;

(4) the thickness is approximately 2 millimeters;

(5) the distance from the distal end that the ball strikes the scoop means is about 4 inches or 10 centimeters, therefore L=(48−10)=38 centimeters;

(6) the mass of the ball is 80 grams;

(7) the polar moment of inertia is about $13.9\times10^4$ grams-centimeters$^2$;

(8) the coefficient of restitution of the 80 grams ball is 0.68;

(9) the center of gravity from the end of the cup is about 6 inches or about 15.3 centimeters.

Therefore, $$\frac{(80)\times(38)^2}{13.9\times10^4}=.82>.68$$

As can be seen from Examples I, II and III, the scoop device satisfy the condition that the different weight balls will be captured when they hit the scoop means because in each example the left-hand side of the equation is greater than the coefficient of restitution for the ball.

Once the basic embodiments of the chelesta and ball were defined, these embodiments of these devices were adapted to a court. Although it was found that a simple solid wall, i.e., such as a concrete wall, could be used by one or more players to play a rudimentary-type game (the wall was similar to a tennis batting board or tennis practice wall). And it was also found that a slightly more sophisticated game could be played with the chelesta and ball in a three walled court (front wall and side walls) such as exists in some parts of the United States (particularly in areas with warmer climates). We determined that the preferred embodiment of our inventive game and method of play combining the scoop device, ball and court into a total game could best be accomplished by providing a method of play where the chelesta and ball were tuned to a standard racquetball court. The standard racquetball court which has a first pair of walls each about 40 feet long, a second pair of walls each about 20 feet long, a floor with each of the walls being approximately perpendicular to the floor and the walls being at least 10 feet high was by far the best playing court. However, a squash court is useable with balls having a lower coefficient of restitution.

The preferred embodiments of the scoop device and ball as described hereinbefore are those that were tuned or impedanced matched to a racquetball court in order to produce a pleasurable game to play, thus, providing kinesthetic pleasure to the players.

Once the preferred type of court was selected for our game, balls were tested in the court to insure a good scoop device-ball match to the court. Balls having a coefficient of restitution (calculated at about a 230 inch drop) of less than 0.6 were found not lively enough to play since the ball would not rebound with a sufficient velocity from the front playing wall with a normal throw. Conversely, balls having a coefficient of restitution greater than 0.75 were determined to be too lively. The most satisfactory balls are those having a coefficient of restitution of about 0.64 to about 0.73.

This scoop device-ball-court combination produces a synergistic relationship between the three components that provide a unique, playable and pleasurable game. This synergistic effect can be better understood because it is fully contemplated by the invention that when energy is transferred from one system to another, whether it be an amplifier driving an audio speaker, a hammer driving a nail or a scoop device either catching or throwing a ball, that this energy transfer is the most efficient when there is good impedance match between the two systems. In the scoop device ball game there must be good impedance match between the four basic elements, to wit: the scoop device, the ball, the court and a human. This term "impedance matching" is difficult to explain to one unfamiliar with the concept, even though the process of impedance matching is used constantly by many people. As an example of a very poor impedance match where there is substantially no energy transfer, suppose a ping pong ball is lying on a billiard table and it is struck by a similar size steel ball. The ping pong ball flies off the table but the steel ball continues rolling along its path almost unaffected by the impact because there has been very little transfer of energy. Conversely, if the steel ball is at rest and is hit by a ping pong ball, then the steel ball barely moves and the ping pong ball rebounds with almost its initial speed. Again, there has been very little energy transfer.

On the other hand, when a billiard ball hits another billiard ball squarely, there is almost a 100 percent transfer of energy because of the nearly perfect impedance match. Thus, the impedance of a system might be characterized as a degree of difficulty met in transferring energy to or from that system.

When energy is to be transferred from one system to another of greatly differing impedance, an appropriate "transformer" is used as an impedance-matching device. For example, to change a tire, a jack is used to match the impedance of the man to that of the weight of the car. To drive a nail, a hammer is used to match the impedance of a man to that of the nail—and no one uses a hammer to close a door because the impedance match is already pretty good between the individual and the door—no transformer is necessary. An example may aid in appreciating the importance of the accurate impedance match: visualize attempting to play tennis with a badminton racquet or badminton with a tennis racquet. One is almost impossible as the other, though the two racquets are almost identical in structure: a strung frame with an elongated handle. A tennis racquet is not a good impedance matching transformer between a human and a badminton birdie, and a badminton racquet is not a good impedance-matching transformer between a human and a tennis ball. In most sports, this impedance match has been worked out by trial and error over extended periods of time, some times as much as centuries. In our invention, this process of impedance matching has been greatly accelerated by careful mathematical analysis and tuning the scoop device, ball and court to humans to produce a pleasurable game.

Figure 18:
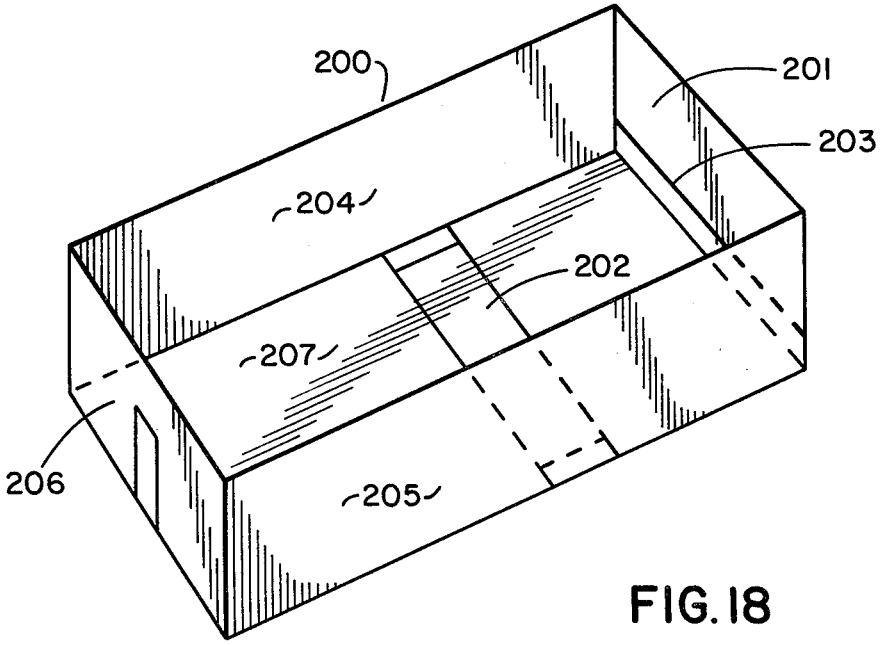
FIG. 18 is a perspective view of one embodiment of a court used for the inventive method of play.

Consequently, our method of playing a scoop device ball game invention is completely different from all court style games such as tennis, racquetball, squash, badminton, aerial darts (a badminton type game played with a hard paddle and a birdie) since the racquet is used in court play to strike or hit the ball or birdie. Our scoop device ball game has one similarity to handball in that it is played in a closed wall court; however, in handball the ball coming off the forward wall is not caught but struck or hit with the hand. Our scoop device ball game does have two aspects similar to jai alai in that a ball catching device is used to catch and the same device is used to throw the ball. We have developed our game utilizing the unique relationship between the scoop device, the ball and the court such that the ball is of a sufficient dynamic coefficient of friction between the ball and scoop means whereby the catching and throwing element causes a ball to roll off the scoop means with spin thereby being able to produce unique shots that rebound off the front and side walls in an unexpected manner. In the perspective view of the court arrangement shown in FIG. 18, the court 200 has a front wall 201 and a serving box 202 that is approximately 5 feet wide located about 15 feet back from the front wall 201. The front wall also has a telltale line 203 located between up to 18 inches above the floor line.

One of the most outstanding and unique characteristics of the game is that when the scoop-cup element is used by a player properly (after the element has been secured to the player's hand properly) and wherein the scoop-cup element or scoop device is held approximately parallel to the floor, that a ball rebounding from the front wall striking the scoop means between the distal end 12 and within a distance of approximately 20 centimeters from the distal end (toward the cup means), that the ball will travel or roll up into the cup means 14 if there is a slight give by the player's hand. The ball striking the scoop means is depicted in FIG. 17. The prevention of bounce out of the ball from the scoop means is due to the design of the scoop means such that the coefficient of restitution of the ball is less than the value of the quantity $$mL^2/I$$

for the scoop-cup element or scoop device. This same catching ability applies to balls rebounding from side walls or the floor; but, it is most dramatic when the scoop-cup element or scoop device is held parallel to the floor. This inventive feature of the invention completely distinguishes it from all other game playing devices or games.

In playing the scoop device ball game, the ball is served by the first player by first bouncing the ball within the confines of the served box 203 and then capturing or catching the ball with the scoop-cup element (more narrowly referred to hereinbefore as a scoop device) and propelling the ball toward the front or forward wall 201. The second player must catch the ball in the element before it bounces on the floor twice. Once caught, the second player can throw the ball toward the front wall 201 directly. Alternatively, the second player can throw the ball towards one of the elongated side walls 204 or 205 in such a manner that the ball will ultimately strike the front wall 201, rebounding therefrom directly or from another elongated side wall. The first player must then catch and throw the ball ultimately back towards the front wall 201 as described above. A "legal return" as used hereinafter defines the proper return of a ball from the front or side walls by catching the ball while in play, either on the fly or after a first bounce on the floor and before the ball touches the floor a second time. The ball can rebound directly from the front wall 201, a side wall 204 or 205 or directly from the back wall 206 and still be in play. Each legal return after a serve is called a "rally". Play during the rally comprises:

(1) front and side wall returns wherein the ball rebounds from the front wall 201, the side wall 204 or 205, the ceiling (if there is one) or the floor 207 and must be caught cleanly and thrown back toward the front wall 201 without a noticeable pause, or (2) a back wall return wherein the ball rebounding from the back wall 206 is thrown without a separate catching motion (with the effect that the ball's motion toward the front wall 201 is not slowed down as a result of the ball's contact with the scoop-cup element).

When a scoop device is used for a back wall return, the ball stays within the scoop means 11 and never enters into the cup means 14. This type of play off the back wall 206 is referred to as a rebote. The time the ball is in the scoop means 11 must be less than one second, and preferrably only a fraction of a second. Any ball that contacts the playing element, i.e., the scoop device, more than once during any return is called a "juggle" and results in a point out or fault.

Points are scored only when the serving player or side (if doubles are played) serves an ace (a legal serve that is not returned by the receiving player) or wins a rally because the other player or side has committed a fault.

In the event that the ball strikes the front wall on or below the telltale line 203 then a fault is declared.

It has been found that the dynamic coefficient of friction between the ball and the walls of the court should range from 0.1 to 0.4 and can be measured in a manner similar to the method used to measure the dynamic coefficient of friction between the ball and the scoop means.

The following is a full and complete set of rules for the scoop device ball game that can be played with the scoop-cup element or scoop device described herein. The rules of the scoop device game include:

(1) the game description;

(2) the arrangement of the court;

(3) the equipment required;

(4) the regulations of play; and
(5) a glossary of terms.
The rules are:

Part 1. The Game

Rule 1.1—Types of Games
The game may be played by two (singles), three (cut throat), or four (doubles) players.
Rule 1.2—Description
Cestaball is a competitive game in which the ball is caught and thrown with a scoop-cup element.
Rule 1.3—Objective
The object is to win each rally by serving or returning the ball so the opponent is unable to keep the ball in play. A rally is over when a side makes an error, or is unable to return the ball before it touches the floor twice.
Rule 1.4—Points
Points are scored only by the serving side when it serves an ace or wins a rally. When the serving side loses a rally, it loses the serve.
Rule 1.5—Game
A game is won by the side first scoring 15 points.
Rule 1.6—Match
A match is won by the side first winning two games.

Part II. Courts and Equipment

Rule 2.1—Courts
The specifications for the court are approximately the same as for the standard four-wall racquetball court:
(a) Dimension. The dimensions shall be 20 feet wide. 10 feet high, and 40 feet long, with the backwall at least 10 feet high.
(b) Lines and Zones. Scoop device courts shall be divided and marked on the floors with 1½ inch wide lines as follows:
(1) Short line. The short line is midway between and is parallel with the front and back walls dividing the court into equal front and back courts.
(2) Service line. The service line is parallel with and located 5 feet in front of the short line.
(3) Service box. The service box is the space between the outer edges of the short and service lines.
(4) Service zone. A service zone is located at each end of the service box by lines 18 inches from and parallel with each side wall.
(5) Receiving Lines. Five feet back of the short line, vertical lines shall be marked on each side wall extending 3 inches from the floor.
(6) Telltale. The telltale is a line across the front wall, parallel to the floor, up to 18 inches from the floor to the top of the line. Any ball hitting on or below the line is out of play and results in a point or an out.

Part III. Play Regulations

Rule 3.1—Serve
(a) Order. The player or side winning the toss becomes the first server and starts the first game, and the third game, if any.
(b) Start. Games are started by the referee calling "play ball" (if there is a referee).
(c) Place. The server may serve from any place in the service box. No part of either foot may extend beyond either line of the service box. Stepping on the line (but not beyond it) is permitted. Server must remain in the service box until the served ball passes short line. Violations are called "foot faults".
(d) Manner. In serving, the ball is required to be bounced on the floor in the service box, caught in the scoop device on the first bounce and thrown so it hits the front wall first and on the rebound hits the floor back of the short line, either with or without touching one of the side walls. If the server fails to catch the ball from the bounce, it is an out.
(e) Fault. One serve is allowed for each point. If a fault occurs, it is an out.
(f) Readiness. The server shall not serve until his opponent is ready or the Referee calls "play".
Rule 3.2—Fault Serves
The following serves are faults and result in an out:
(a) Foot Faults. A foot fault results:
(1) When the server leaves the service box before the served ball passes the short line.
(2) When the server's partner leaves the service zone before the served ball passes the short line.
(b) Short Serve. A short serve is any served ball that first hits the front wall and on the rebound hits the floor in front of the back edge of the short line either with or without touching one side wall.
(c) Three-Wall Serve. A two-side serve is any ball that first hits the front wall and on the rebound hits two side walls on the fly.
(d) Ceiling Serve. A ceiling serve is any served ball that touches the ceiling after hitting the front wall either with or without touching one side wall.
(e) Long Serve. A long serve is any served ball that first hits the front wall and rebounds to the back wall before touching the floor.
(f) Missed Ball. Any ball that is not caught from the bounce.
(g) Non-front Serve. Any served ball that strikes the server's partner, or the ceiling, floor or side wall, before striking the front wall.
(h) Touched Serve. Any served ball that on the rebound from the front wall touches the server or touches the server's partner while any part of his body is out of the service box, or the server's partner intentionally catches the served ball on the fly.
(i) Out-of-Order Serve. In doubles, when either partner serves out of order. Any points which may have been scored during an out-of-order serve will be automatically void with the score reverting to the score prior to the out-of-order serve.
Rule 3.3—Receiving Service
(a) Receiving Position. The receiver or receivers must stand at least 5 feet back of the short line and cannot return the ball until it passes the short line. Any infraction results in a point for the server.
(b) Legal Return. After the ball is legally served, one of the players on the receiving side must catch the ball either on the fly or after the first bounce and before the ball touches the floor the second time, and return the ball to the front wall either directly or after touching one or both side walls, the ceiling or any combination of those surfaces. It is *not* legal to return the ball by striking the back wall first.
Rule 3.4—Rallies
Each legal return after the serve is called a rally. Play during the rallies shall be according to the following rules:
(a) Front Wall Returns. Balls rebounding from the front wall, a side wall, the ceiling or the floor must be caught cleanly, and thrown immediately with a noticeable pause.

(b) Back Wall Returns. Balls rebounding from the back wall are thrown without a separate catching motion. The effect is that the ball's motion towards the front wall is not slowed down as a result of its contact with the scoop device.

(c) Juggles. Any ball that contact the scoop device more that once during any return is called a juggle and results in a point or an out.

Rule 3.5—Dead Ball Hinders.

Hinders are of two types—"dead ball" and "avoidable". Dead ball hinders as described in this rule result in the point being replayed.

(a) Situations. When called by the referee the following are dead ball hinders:

(1) Court Hinders. Hits any part of the court which under local rules is dead ball.

(2) Hitting Opponent. Any returned ball that touches an opponent on the fly before it returns to the front wall.

(3) Body Contact. Any body contact with an opponent that interfers with seeing or returning the ball.

(4) Screen Ball. Any ball rebounding from the front wall close to the body of a player on the side which just returned the ball, to interfere with or prevent the returning side form seeing the ball.

(5) Straddle Ball. A ball passing between the legs of a player on the side which just returned the ball, if there is no fair chance to see or return the ball.

(6) Other interference. Any other unintentional interference which presents an opponent from having a fair chance to see or return the ball.

Rule 3.6—Avoidable Hinders.

An avoidable hinder results in an "out" or a point depending upon whether the offender was serving or receiving.

(1) Failure to Move. Does not move sufficiently to allow opponent his shot.

(2) Blocking. Moves into a position effecting a block, on the opponent about to return the ball, or, in doubles, one partner moves in front of an opponent as his partner is returning the ball.

(3) Moving into Ball. Moves in the way and is struck by the ball just played by his opponent.

(4) Pushing. Deliberately pushes or shoves opponent during a rally.

Part IV. Glossary

Ace: Legal serve that eludes the receiver, scoring a point.

Avoidable Hinder: Avoidable interference by one player with another's clear shot. Penalty is loss of serve or point.

Back Court: Court area back of short line.

Block (or Screen): Preventing your opponent from viewing the ball.

Court Hinder: Construction obstacle that deflects ball (light fixtures, latches). Point is replayed.

Cutthroat: Game with three players with each server during his turn playing the other two players.

Dead Ball: Any ball out of play, especially following penalty.

Dead Ball Hinder: Unavoidable interference with opponent or flight of ball. No penalty.

Doubles: Game of two teams of two players each.

Drive: Game of two teams of two players each.

Fault: Illegal serve or other infraction of serving rules.

Foot Fault: Illegal placement of foot outside serve zone during serve.

Front Court: Area in front of short line

Front Line: See service line.

Hand-out: Loss of serve by first partner serving for his team in doubles.

Kill: Shot to front wall that rebounds too close to floor to be returned.

Long Serve: Any serve that rebounds to the back wall without first striking the floor.

Out: Loss of serve when server faults or fails to sustain the rally.

Point: Tally scored by successful server.

Rally: Period of play from time ball is served until one side fails to return ball to front wall.

Rebote: The continuous play off the back wall, i.e., catch and throw in one motion.

Receiver: Player to whom ball is served.

Serve: The act of putting ball in play.

Server: Player putting ball in play.

Service Zone: The demarcated box 18 inches from side wall in which non-serving member of doubles serving team stands with back to wall during serve.

Service Line: Line parallel to and five feet in front of short line.

Service Box: Court area between short line and service line (also called service lane).

Shadow Serve: Serve concealed from receiver's view on rebound until it passes server.

Short: Serve that fails to rebound past short line. Illegal.

Short Line: Line halfway between and parallel to front and back walls.

Side-Out: Loss of serve by singles player, or, in doubles, by team.

Singles: One player playing against another.

Straddle Ball: Ball that goes between legs of player.

Telltale: The line across the front wall, parallel to the floor, up to 18 inches from the floor to the tip of the line that defines the area of the court flat is out of play.

Three-wall Serve: Serve that hits three walls on the fly. Illegal.

Two-side Serve: Any serve that hits two sides on the fly.

Thus, the full and complete extent of our inventive method of play is incorporated in the rules of play. Some aspects of rules are more important than others. Some of the basic aspects of the rules are important for our method of play and have been very specifically claimed as part of our invention while other aspects enhance the sophistication of our method of play in the game that is defined.

Although specific embodiments of the inventive method have been described, many modifications and changes may be made to our method of play and rules and these are fully contemplated without departing from the spirit and scope of the invention as defined in the appended claims.

What is claimed is:

1. A method of playing a ball game comprising the steps of:

(A) providing a rectangular court having a floor and two pairs of oppositely facing walls, one pair of walls comprising side walls and being approximately 40 feet long and the other pair of walls comprising a front wall and a back wall, each being about 20 feet long, the walls being at least 10 feet high;

(B) providing a ball having a weight ranging from 70 to 90 grams;

(C) providing at least one catching and throwing element comprising a scoop means having an inner and outer surface with a distal end and a proximal end, and a ball holding cup means having inner and outer surfaces with an open edge and a closed edge, the closed edge secured to the proximal end thereby defining a scoop-cup means, the scoop means having an elongated central first axis extending from the distal end to the proximal end, a portion of the scoop means along the first axis having a portion thereof in the configuration of a segment of a hyperbolic spiral, the spiral having a formula in which the polar coordinates RO equal a constant C ($R\theta=C$) and wherein the values of R range from 1.5 to 60 centimeters and the values of the constant C range from 10 to 30 centimeter-radians when $\theta$ is measured in radians; and, (D) using the element for attempting to throw the ball toward the front wall and using means for attempting to catch the ball rebounding from the front wall, side walls, or floor before the ball touches the floor twice and then immediately attempting to throw the ball toward the front wall so that the ball does not touch the floor before it strikes the front wall.

2. The method of claim 1 further including the step of attempting to prevent an out by throwing the ball against the front wall before the ball first touches the back wall.

3. The method of claim 1 wherein a fault results when attempting to catch and throw the ball but the ball is allowed to strike the floor twice before it is caught.

4. The method of claim 1 further including the step of attempting to rebound the ball from the back wall and attempting to throw it toward the front wall without a catching motion such that the ball remains in the scoop means no more than one second.

5. The method of claim 1 further including the step of attempting to serve the ball by first bouncing the ball off the floor and catching it in the scoop of the element and throwing it against the front wall.

6. The method of claim 1 further including the step of attempting to catch the ball in cup means of the element.

7. The method of claim 1 further including the step of attempting to assist in rebounding the ball from the back wall and attempting to throw it toward the front wall without a catching motion such that the ball remains on the scoop means of the element and does not enter the cup means.

8. The method of claim 1 wherein the dynamic coefficient of friction of the surface of the ball as measured against the surface of the scoop means ranges from 0.1 to 0.4.

9. The method of claim 7 wherein during the attempted rebounding step, the ball from the back wall is thrown toward the front wall in a manner such that the ball does not make a substantial striking noise against the scoop means.

10. The method of claim 1 wherein there is a telltale foul line on the front wall.

11. The method of claim 10 wherein the line ranges up to 18 inches above the floor.

12. A method of playing a cestaball game comprising the steps of:

(A) providing a rectangular court having a floor and two pairs of oppositely facing walls, a first pair of walls comprising side walls and being approximately 40 feet long and a second pair of walls comprising a front wall and a back wall, each being about 20 feet long, the walls being at least 10 feet high;

(B) providing a ball having a weight ranging from 70 to 90 grams;

(C) providing at least one catching and throwing element comprising a scoop means having an inner and outer surface with a distal end and a proximal end, and a shaped ball holding cup means having inner and outer surfaces with an open edge and a closed edge, the closed edge secured to the proximal end thereby defining a scoop-cup means, the scoop means having an elongated central first axis extending from the distal end to the proximal end, a portion of the scoop means along the first axis having a portion thereof in the configuration of a segment of a hyperbolic spiral, the spiral having a formula in which the polar coordinates RO equal a constant C ($R\theta=C$) and wherein the values of R range from 1.5 to 60 centimeters and the values of the constant C range from 10 to 30 centimeter-radians when $\theta$ is measured in radians;

(D) providing a service box delineated on the floor and extending between the side walls and being parallel to the front wall;

(E) providing each of a first player and a second player with an element; and (F) the first player attempting to serve the ball by first holding the element and then bouncing the ball while standing in the service box.

13. The method of claim 12 wherein after bouncing the ball, the first player attempts to catch the ball in the element on the first bounce.

14. The method of claim 13 wherein after catching the ball in the element, the first player attempts to throw the ball towards the front wall so that it hits the first wall before hitting the floor.

15. The method of claim 14 further providing a telltale foul line across the front wall parallel to the floor and spaced approximately up to 18 inches above the floor.

16. The method of claim 15 wherein the ball hitting the front wall above the telltale line is in play.

17. The method of claim 15 wherein the ball hitting the front wall below the telltale line causes a fault and stops play.

18. The method of claim 16 wherein the ball rebounds from the front wall a first time and the second player attempts to catch the ball on the fly in a second element and attempts to throw it back toward the front or side walls.

19. The method of claim 16 wherein the ball rebounds from the front wall a first time and thereafter the second player attempts to catch the ball in a second element and attempts to throw it back toward the front or side walls before the ball bounces on the floor twice.

20. The method of claims 18 or 19 wherein the second player by attempting to catch and throw the ball back toward the front or side wall attempts to start a rally.

21. The method of claims 18 or 19 wherein after the ball rebounds from the front or side walls, the first player attempts to catch the ball with the element and attempts to throw it back towards the front or side wall before the ball bounces on the floor twice.

22. The method of claim 18 or 19 wherein the ball rebounds from the front or side wall and thereafter before the ball bounces twice on the foor, the first player attempts to catch the ball with the element and attempts to throw it against the front wall with such force that the ball rebounds directly from the front wall against the back wall without touching the floor.

23. The method of claim 22 wherein the second player using the second element contacts the ball rebounding from the back wall with the inner surface of the scoop means and attempts to increase the velocity of the ball traveling toward the front wall so that the ball strikes the front wall without striking the floor twice.

24. The method of claim 14 wherein the serving box has two spaced apart lines between the front wall and the back wall.

25. The method of claim 24 wherein the first player must remain in the service box until the served ball passes beyond the service box moving toward the front wall.

26. The method of claim 13 wherein the first player attempting to serve fails to catch the bounded ball in the element thereby causing a fault.

27. The method of claim 13 wherein after attempting and catching the bounced ball with the element the first player steps between the service box and the front wall and causes a fault.

28. The methods of claims 14 or 16 wherein after the ball hits the front wall and rebounds therefrom the second player attempting to catch the ball with the second element permits the ball to strike the floor twice thereby causing a fault and providing the first player with a point.

29. The method of claim 28 wherein after the second player causes a fault, the first player is permitted a second turn to serve the ball.

30. The method of claim 23 wherein the second player is not permitted to hold the ball against the inner surface of the scoop means for more than one second.

31. The method of claim 23 wherein the second player attempting to play the ball must contact the ball with the scoop means of the second element and increase its velocity towards the front wall in one continuous motion.

32. The method of claim 31 wherein this mode of contact with the ball is called a rebote shot.

33. The method of claim 14 wherein after catching the ball the first player attempting to throw the ball toward the front wall permits the ball to hit the floor before striking the front wall thereby causing a fault.

34. The method of claims 18 or 19 wherein the serving box has two spaced apart lines between the front wall and the back wall.

35. The method of claim 34 wherein the ball after it rebounds from the front wall but before it passes over both spaced lines hits the floor thereby causing a fault.

36. The method of claim 24 wherein the ball strikes the front wall and rebounds therefrom over the serving box and the second player does not catch the ball with a second element before the ball strikes the ground twice thereby creating a fault.

37. The method of claim 36 wherein the first player is awarded a point since the second player causes a fault during the first player's serving period.

38. The method of claim 37 wherein the player to first be awarded 15 points wins the game.

39. A method of playing a ball game comprising the steps of:

(A) providing a rectangular court having a floor, two pairs of oppositely facing walls, one pair of walls comprising side walls and being approximately 40 feet long and the other pair of walls comprising a front wall and a back wall, each being about 20 feet long, the walls being at least 10 feet high and a ceiling parallel to the floor, the front wall having a telltale line up to 18 inches above the floor;

(B) providing a ball having a weight ranging from about 70 grams to about 90 grams and a coefficient of restitution ranging from about 0.65 to about 0.80;

(C) providing for a first and a second player;

(D) providing each player with a throwing and catching element comrising the scoop means having inner and outer surfaces with a distal end and a proximal end, a ball holding cup means having an inner surface for holding a ball and an outer surface, the cup means having an open edge and a closed edge, the cloed edge secured to or integral with the proximal end of the scoop means thereby defining a scoop-cup means, the scoop means having an elongated central first axis extending from the distal end to the proximal end, a portion of the scoop means along the first axis having a portion thereof in the configuration of a segment of a hyperbolic spiral, the spiral having a formula in which the polar coordinates $R\theta$ equal a constant C ($R\theta=C$) and wherein the values of R range from 1.5 to 60 centimeters and the values of the constant C range from 10 to 30 centimeter-radians when $\theta$ is measured in radians;

(E) providing a service box located on the floor extending between the side walls and being parallel to the front wall;

(F) attempting to serve the ball by the first player first bouncing the ball in the service box then catching the ball in the scoop-cup means; and (G) thereafter attempting to throw the ball so that the ball strikes the front wall before it hits the floor.

40. The method of claim 39 wherein the served ball to stay in play return from the front wall across the service box before hitting the floor and rebounding therefrom.

41. The method of claim 39 wherein the served ball first rebounds hitting the floor only once after crossing the service box and then strikes the back wall and rebounds therefrom.

42. The method of claim 40 or 41 wherein after the rebound the second player attempts to contact the ball with the inner surface of the scoop means of the element such that the ball does not go into the cup and thereafter the second player attempts to propel the ball toward the front or side walls with a continuous motion.

43. The method of claim 42 wherein after being propelled the ball hits the ceiling before it strikes the front or side walls and remains in play.

44. A method of playing a ball game comprising the steps of:

(A) providing a rectangular court having a floor and two pairs of oppositely facing walls, one pair of walls comprising side walls and being approximately 40 feet long and the other pair of walls comprising a front wall and a back wall each being about 20 feet long, the walls being at least 10 feet high;

(B) providing a ball having a weight ranging from 70 to 90 grams;

(C) providing at least two catching and throwing elements comprising a scoop means having an inner and outer surface with a distal end and a proximal end, and a shaped ball holding cup means having inner and outer surfaces with an open edge and a closed edge, the closed edge secured to the proximal end thereby defining a scoop-cup means, a portion of the scoop-cup means having a portion thereof in the shape of a hyperbolic spiral, the spiral having a formula in which the polar coordinates $R\theta$ equal a constant C ($R\theta=C$) wherein the values of R range from 1.5 to 60 centimeters and the values of the constant C range from 10 to 30 centimeter-radians when $\theta$ is measured in radians;

(D) using the element for attempting to throw the ball against the front wall before it strikes the floor or any other walls; and (E) using a second element for attempting to catch the ball rebounding from the front wall, side walls, or floor before the ball touches the floor twice and then immediately throwing the ball toward the front wall so that the ball does not touch the foor before it strikes the front or side walls.

45. A method of playing a game comprising the steps of:

(a) each player using an element comprising:

(i) an elongated scoop means having inner and outer surfaces, a tip end, a base end and a pair of outwardly and upwardly facing edges;

(ii) a curvilinear shaped ball cup means having inner and outer surfaces, an open edge and a closed edge, the closed edge secured to the base end of the scoop;

(iii) the scoop means having an elongated central axis extending from the tip of the base, a portion of the scoop means along the axis having a portion thereof in the configuration of a segment of a hyperbolic spiral, the spiral having a formula in which the polar coordinates RO equal a constant C (RO=C) and wherein the values of R range from 1.5 to 60 centimeters and the values of the constant C range from 10 to 30 centimeter-radians when O is measured in radians;

(b) using a ball having a weight ranging from about 70 grams to about 90 grams; and (c) providing a court having a floor and two pairs of oppositely facing walls, one pair of walls comprising side walls and being approximately 40 feet long and the other pair of walls comprising a front wall and a back wall, each being about 20 feet long, the walls being at least 10 feet high;

(d) complying with the rules comprising:

Rule 1.1—Types of Games

The game may be played by two (singles), three (cut throat), or four (doubles) players;

Rule 1.2—Description

Cestaball is a competitive game in which the ball is caught and thrown with a scoop-cup element;

Rule 1.3—Objective

The object is to win each rally by serving or returning the ball so the oponent is unable to keep the ball in play; a rally is over when a side makes an error, or is unable to return the ball before it touches the floor tiwce;

Rule 1.4—Points

Points are scored only by the serving side when it serves an ace or wins a rally; when the serving side loses a rally, it loses the serve;

Rule 1.5—Game

A game is won by the side first scoring 15 points;

Rule 1.6—Match

A match is won by the side first winning two games;

Rule 2.1—Courts

The specifications for the court are approximately the same as for the standard four-wall racquetball court:

(a) Dimension: the dimensions shall be about 20 feet wide, 10 feet high, and 40 feet long, with the backwall at least 10 feet high;

(b) Lines and Zones: Cestaball courts shall be divided and marked on the floors with wide lines as follows:

(1) Short line: The short line is midway between and is parallel with the front and back walls dividing the court into equal front and back courts, (2) Service line: The service line is parallel with and located about 5 feet in front of the short line, (3) Service box: The service box is the space between the outer edges of the short and service lines;

(4) Service zone: A service zone is located at each end of the service box by lines around 18 inches from and parallel with each side wall;

(5) Telltale: The telltale is a line across the front wall approximately parallel to the floor, up to 18 inches from the floor to the top of the line; any ball hitting on or below the line is out of play and results in a point or an out;

Rule 3.1—Serve (a) Order: The player or side so selected becomes the first server and starts the first game, and the third game, if any;

(b) Start: Games are started by the referee calling "play ball" (if there is a referee);

(c) Place: The server may serve from any place in the service box; no part of either foot may extend beyond either line of the service box; stepping on the line (but not beyond it) is permitted; server must remain in the service box until the served ball passes short line; violations are called "foot faults";

(d) Manner: In serving, the ball is required to be bounced on the floor in the service box, caught in the element on the first bounce and thrown so it hits the front wall first and on the rebound hits the floor back of the short line, either with or without touching one of the side walls; if the server fails to catch the ball from the bounce, it is an out;

(e) Fault: One serve is allowed for each point; if a fault occurs, it is an out;

(f) Readiness: The server shall not serve until his opponent is ready or the Referee calls "play";

Rule 3.2—Fault Serves

The following serves are faults and result in an out:

(a) Foot Faults: A foot fault results:

(1) When the server leaves the service box before the served ball pases the short line;

(2) When the server's partner leaves the service zone before the served ball passes the short line (b) Short serve: A short serve is any served ball that first hits the front wall and on the rebound hits the floor in front of the back edge of the short line either with or without touching one side wall;

(c) Three-Wall Serve: A two-side serve is any ball that first hits the front wall and on the rebound hits two side walls on the fly;

(d) Ceiling Serve: A ceiling serve is any served ball that touches the ceiling after hitting the front wall either with or with out touching one side wall;

(e) Long Serve: A long serve is any served ball that first hits the front wall and rebounds to the back wall before touching the floor;

(f) Missed Ball: any ball that is not caught from the bounce;

(g) Non-front Serve: Any served ball that strikes the server's partner, or the ceiling, floor or side wall, before striking the front wall;

(h) Touched Serve: Any served ball that on the rebound from the front wall touches the server or touches the server's partner while any part of his body is out of the service box, or the server's partner intentionally catches the served ball on the fly;

(i) Out-Of-Order Serve: In doubles, when either partner serves out of order; any points which may have been scored during an out-of-order serve will be automatically void with the score reverting to the score prior to the out-of-order serve.

Rule 3.3—Receiving Service (a) Receiving Position: The receiver or receivers must stand at least 5 feet back of the short line and cannot return the ball until it passes the short line; any infraction result in a point for the service;

(b) Legal Return: After the ball is legally served, one of the players on the receiving side must catch the ball either on the fla or after the first bounce and before the ball touches the floor the second time, and return the ball to the front wall either directly or after touching one or both side walls, the ceiling or any combination of those surfaces; it is *not* legal to return the ball by striking the back wall first;

Rule 3.4—Rallies

Each legal return after the serve is called a rally; play during the rallies shall be according to the following rules:

(a) Front Wall Returns; Balls rebounding from the front wall, a side wall, the ceiling or the floor must be caught cleanly, and thrown immediately with a noticeable pause;

(b) Back Wall Returns: Balls rebounding from the back wall are thrown without a separate catching motion; the effect is that the ball's motion towards the front wall is not slowed down as a result of its contact with the element;

(c) Juggles: Any ball that contact the element more than once during any return is called a juggle and results in a pont or an out;

Rule 3.5—Dead Ball Hinders:

Hinders are of two types—"dead ball" and "avoidable"; dead ball hinders as described in this rule result in the point being replayed;

(a) Situations: When called by the referred the following are dead ball hinders:

(1) Court Hinders: Hits any part of the court which under local rules is dead ball;

(2) Hitting Opponent: Any returned ball that touches an opponent on the fly before it returns to the front wall;

(3) Body Contact: Any body contact with an opponent that interferes with seeing or returning the ball;

(4) Screen Ball: any ball rebounding from the front wall close to the body of a player on the side which just returned the ball, to interfere with or prevent the returning side from seeing the ball;

(5) Straddle Ball: A ball passing between the legs of a player on the side which just returned the ball, if there is no fair chance to see or return the ball;

(6) Other Interference: Any other unintentional interference which presents an opponent from having a fair chance to see or return the ball;

Rule 3.6—Avoidable Hinders;

An avoidable hinder results in an "out" or a point depending upon whether the offender was serving or receiving;

(1) Failure to Move: Does not move sufficiently to allow opponent his shot;

(2) Blocking: Moves into a position effecting a block, on the opponent about to return the ball, or, in doubles, one partner moves in front of an opponent as his partner is returning the ball;

(3) Moving into Ball: Moves in the way and is struck by the ball just played by his opponent;

(4) Pushing: Deliberately pushes or shoves opponent during a rally.

* * * * *